US007069814B2

(12) United States Patent
Chervak et al.

(10) Patent No.: US 7,069,814 B2
(45) Date of Patent: Jul. 4, 2006

(54) APPARATUS FOR FASTENING A LID TO A CONTAINER

(75) Inventors: Steven G. Chervak, Bel Air, MD (US); Arthur F. Yeager, Kailua, HI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/012,733

(22) Filed: Dec. 16, 2004

(65) Prior Publication Data

US 2005/0132845 A1 Jun. 23, 2005

Related U.S. Application Data

(60) Provisional application No. 60/556,029, filed on Mar. 25, 2004, provisional application No. 60/529,701, filed on Dec. 16, 2003.

(51) Int. Cl.
*B67B 7/14* (2006.01)

(52) U.S. Cl. ..... 81/3.39; 81/3.2; 81/3.32; 81/3.4

(58) Field of Classification Search ..... 81/3.39, 81/3.2, 3.25, 3.31, 3.32, 3.33, 3.36, 3.4
See application file for complete search history.

(56) References Cited

U.S. PATENT DOCUMENTS

| | | | | |
|---|---|---|---|---|
| 80,583 | A | 8/1868 | Allard | |
| 352,659 | A | 11/1886 | Petersen | |
| 1,821,194 | A | 9/1931 | Wilcox | |
| 3,159,064 | A | 12/1964 | Woloszyn | |
| 3,812,742 | A * | 5/1974 | Polasek | 81/3.32 |
| 3,971,188 | A | 7/1976 | Cawrse | |
| 4,358,970 | A | 11/1982 | Jacobson | |
| 4,569,281 | A | 2/1986 | Woods | |
| D286,734 | S | 11/1986 | Furman | |
| 4,852,431 | A | 8/1989 | Frangel | |
| 5,054,266 | A | 10/1991 | Mello et al. | |
| 5,165,310 | A * | 11/1992 | Heinrich | 81/3.4 |
| 6,263,761 | B1 | 7/2001 | Ryder | |
| 6,651,531 | B1 | 11/2003 | Thorton | |

* cited by examiner

*Primary Examiner*—Debra S Meislin
(74) *Attorney, Agent, or Firm*—Elizabeth Arwine

(57) ABSTRACT

The present invention is a portable securing apparatus for fastening and unfastening a lid to a container. The apparatus minimizes or prevents health risks of medical conditions associated with repetitive and cumulative motions by minimizing or preventing repetitive motions performed by an individual. The apparatus includes a base and a balancer configured to hold a rotational drive mechanism. The base provides support for the container by allowing the container to rest thereon in an upright position. The balancer is connected to the base and is configured to hold the rotational drive mechanism. The balancer provides for movement of the rotational drive mechanism to engage the container lid.

17 Claims, 5 Drawing Sheets

APPARATUS FOR FASTENING A LID TO A CONTAINER

This patent application claims the benefit of U.S. Provisional Patent Application No. 60/529,701, filed Dec. 16, 2003, and U.S. Provisional Patent Application No. 60/556,029, filed Mar. 25, 2004. Both of these provisional patent applications are hereby incorporated by reference.

I. FIELD OF THE INVENTION

The present invention generally relates to apparatuses for securing devices, and more specifically, to an apparatus for attaching and removing a lid from a container.

II. BACKGROUND OF THE INVENTION

Medical conditions such as Thoracic Outlet Syndrome and Carpal Tunnel Syndrome are sometimes grouped together under the name Cumulative Trauma Disorder (CTD) or Repetitive Stress Injury (RSI). These conditions are often caused by repetitive movements or motions. For example, data entry personnel often experience Carpal Tunnel Syndrome due to the constant and repetitive motions performed by their fingers depressing keys on a keyboard. The disorders also occur in mass-production industries. For instance, assembly-line employees in the automobile manufacturing industry often engage in repetitive motions during the assembly of automobiles. Similarly, employees of a toxicology lab routinely prepare urine specimen samples on a daily basis. In particular, the employees may be required to constantly attach and/or remove lids to specimen containers. Removing and/or attaching lids to the containers typically occurs by a screwing motion to cause the lid to engage or disengage from the container. This motion requires an individual to manipulate the lid off and on with finger prehension and ulnar/radial deviation of the wrist. Thus, the repetitive screwing motion often leads to one of the referenced conditions.

In light of the foregoing, what is needed is a portable, weight-balanced and tension-adjustable apparatus for securing a lid to a container using a bit. Such an apparatus should reduce risks for repetitive injuries resulting from screwing motions and provide assistance to an individual in holding, stabilizing, and precisely aligning the container with the lid, thereby reducing risks associated with other repetitive injuries. Such an apparatus should be compatible with a drill or screwdriver (for example, a battery powered screwdriver). Such a device should also be relatively inexpensive.

III. SUMMARY OF THE INVENTION

The present invention relates to an apparatus adapted to fasten and remove a lid from a container. The apparatus minimizes or prevents health risks of medical conditions associated with repetitive and cumulative motions by minimizing repetitive and cumulative motions performed by an individual. The apparatus preferably includes a base, a balancer coupled to the base and adapted to hold a rotational drive means such as a screwdriver and provide counter tension for weight applied by an operator, and a bit adapted for insertion into the rotational drive means to perform the fastening and removing.

In at least one embodiment, a device for fastening and unfastening a lid to a container, said device including a platform, a post connected to said platform, a slider engaging said post, a tension mechanism in communication with said post, at least one spring connected to said tension mechanism and said slider, a rotational driver device connected to said slider, and a bit attached to said rotational driver device configured to fit around the lid of at least one container.

In at least one embodiment, an apparatus for fastening and unfastening a lid to a container, said apparatus including a platform, a post connected to said platform, a slider in communication with said post, a tension means for resisting movement of said slider relative to said post, at least one bracket attached to said slider, a rotational drive device in communication with said at least one bracket, and at least one bit capable of being attached to said rotational drive means.

In at least one embodiment, an apparatus for fastening and unfastening a lid to a container with a rotational drive device, said apparatus including a platform, a post connected to said platform, a holding means for holding the rotational drive device, a sliding means for sliding said holding means relative to said post, and a tension means for resisting movement of said sliding means relative to said post.

In at least one embodiment, the balancer preferably includes a post, a slide, a first bracket and a second bracket. The slide is preferably interconnected with the post such that the slide moves vertically from a first position on the post to a second position on the post. In at least one embodiment, the slide is a ball-bearing slide. The first bracket and the second bracket are preferably "L-shaped" and are fixedly coupled to the slide. The first bracket includes an opening or hole for allowing the bit-end of the rotational drive means to rest therein. The second bracket includes a retainer ring for grasping a handle of the rotational drive means. In at least one embodiment, the balancer further includes a tension spring, a tension lever for adjusting tension, a fastener, a fastener nut, and a tension lever nut. The tension spring provides tension and counter-tension for the weight of the drive means and the weight of the operator's hand.

It is an object of at least one embodiment of the present invention to provide a portable securing apparatus for attaching and removing a lid to a container.

It is an object of at least one embodiment of the present invention to provide an apparatus that can be utilized in conjunction with a standard screwdriver or drill.

It is an object of at least one embodiment of the present invention to provide a securing apparatus that is cost-effective.

It is an object of at least one embodiment of the present invention to provide a securing apparatus that is ergonomically safe.

An advantage of at least one embodiment of the present invention is that it provides weight-based tension for countering weight applied by an operator.

An advantage of at least one embodiment of the present invention is that the tension can be adjusted to accommodate a variety of applied forces.

An advantage of at least one embodiment of the present invention is that it accommodates both left-handed operators and right-handed operators.

IV. BRIEF DESCRIPTION OF THE DRAWINGS

Like reference numerals in the figures represent and refer to the same element or function throughout the application.

V. DETAILED DESCRIPTION OF THE INVENTION

The present invention relates to a portable apparatus for fastening and removing a lid of a container. The apparatus minimizes or eliminates an individual from having to perform a cumulative and repetitive process such as fastening or unfastening lids from bottles, thereby minimizing or eliminating an individual's risk of health problems, for example, Carpal Tunnel Syndrome, associated with performing such motions.

The apparatus is preferably weight-balanced to provide counter-tension to accommodate the weight of an operator's hand during operation. The apparatus is preferably tension-adjustable to accommodate a variety of desired tensions. In addition, the apparatus is compatible with a standard powered screwdriver or drill, for example. Alternatively, in at least one embodiment, the apparatus preferably includes a powered rotational drive means that is built into the apparatus. In at least one embodiment, the apparatus also preferably includes a bit for securing a lid to a container by a twisting or screwing motion, for example.

Figure 1:
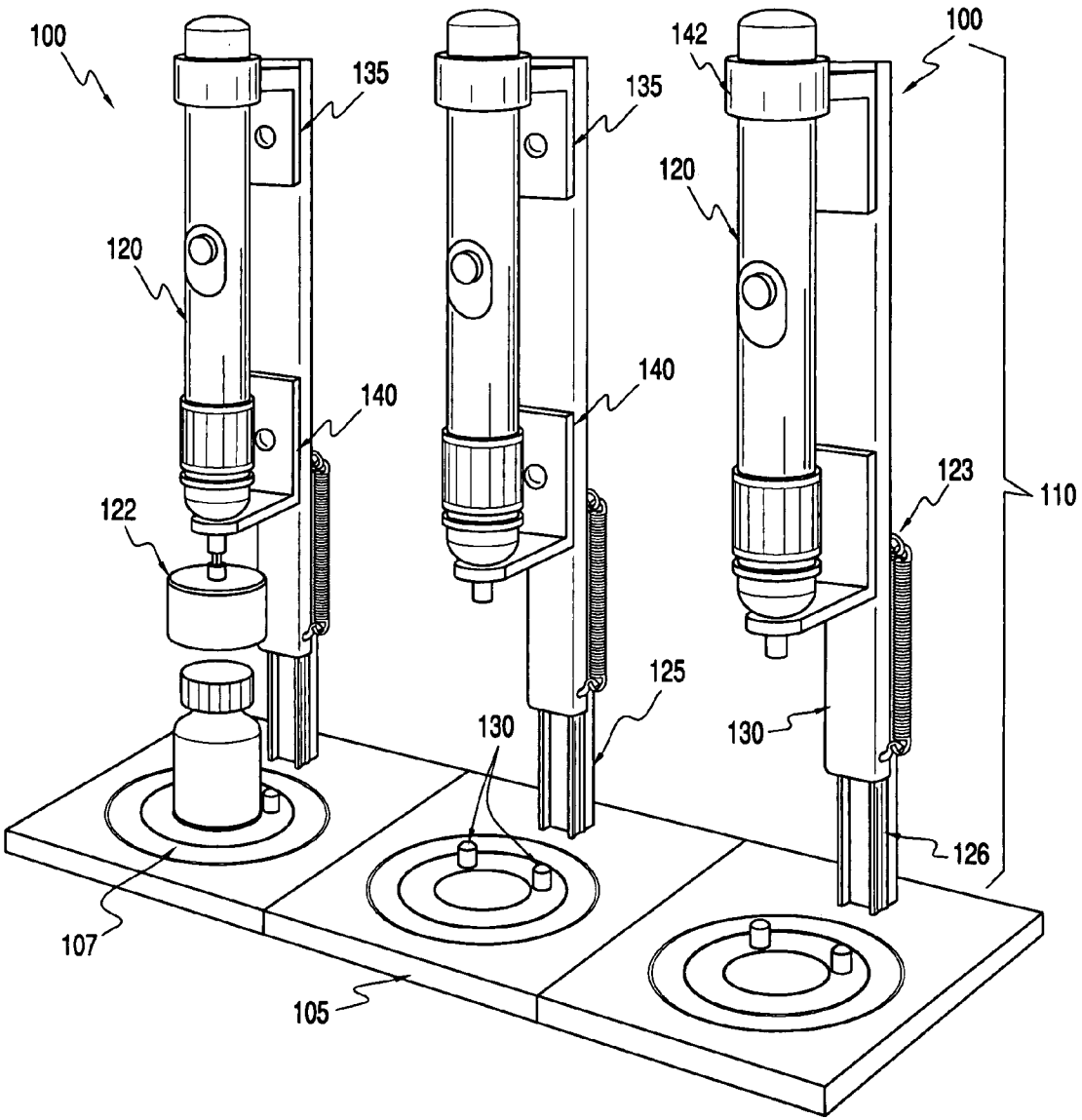
FIG. 1 depicts three apparatuses next to each other according to at least one embodiment of the present invention.

Referring now to FIG. 1, the apparatus 100 of the present invention preferably includes a base (or stand or means for providing support for the apparatus) 105 and a balancer 110. The balancer 110 is adapted to hold a rotational drive device 120 such as a screwdriver or drill and provide counter tension for weight applied to the drive means by an operator.

The base (or platform) 105 preferably serves as a means for providing support for the apparatus 100 and provides a surface for a container, for example, a bottle, as illustrated in FIG. 1, by allowing the container to rest thereon in an upright position, that is, vertically, with the open end of the container facing away from the base 105. The base 105 also provides support for the apparatus 100. The base 105 is preferably manufactured of some combination of rubber, plastic, aluminum, or any other viable material known to those of ordinary skill in the art for providing support. The base 105 is preferably rectangular, and more preferably a square. It should be noted, however, that the base 105 can be circular, triangular, or any other viable shape for supporting the apparatus 100. As illustrated in FIG. 1, the base 105 preferably includes a raised pattern (or restraining means for restraining the container) 107, for example, a pattern of a plurality of concentric ridges, for accommodating a variety of sizes of containers.

In at least one embodiment, the base 105 preferably includes at least two guideposts 130 for securing the container resting on the base 105. As illustrated in, for example, FIG. 6, the bottom of the container rests between the two guideposts 130, thereby temporarily restraining the container and is another example of a restraining means. The guideposts 130 are preferably manufactured or covered with plastic, rubber, aluminum, or any other viable material. More preferably, the guideposts 130 include a friction surface to resist rotation of the container during the opening/closing operation. Examples of friction surface are rubber, foam, or a rough surface. It should be noted that the number of guideposts may vary.

Figure 2:
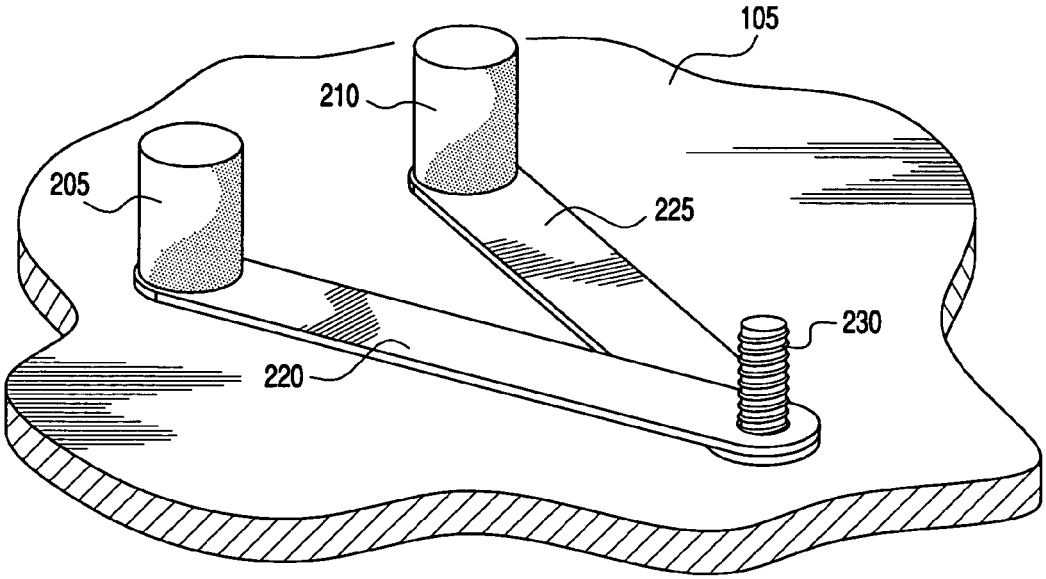
FIG. 2 depicts a base of the apparatus including adjustable guideposts according to at least one embodiment of the present invention.

FIG. 2 depicts an adjustable guidepost system 200, which is another example of a restraining means, for use on top of the base 105. The adjustable guidepost system 200 is preferably utilized to accommodate a variety of sizes of containers. For example, the diameter of the bottom of some urine specimen bottles may be larger than others. As a result, the guideposts 205 and 210 between which the container rests may be adjusted such that the distance between the guideposts 205 and 210 is increased or decreased according to the size of the bottom of the bottle.

The adjustable guidepost system 200 preferably includes a first guidepost 205, a second guidepost 210, a first adjustment arm 220, a second adjustment arm 225, and an adjustment mechanism (or controller) 230. The first adjustment arm 220 preferably includes the first adjustable guidepost 205 coupled thereto. The second adjustment arm 225 preferably includes the second adjustable guidepost 210 coupled thereto. The adjustment mechanism 230 is preferably attached to the base 105 and preferably protrudes through a hole or opening in the first and second adjustment arms 220 and 225, respectfully, as shown in FIG. 2. The adjustment mechanism 230 preferably functions as a pivot post around which the adjustment arms pivot. The adjustment mechanism 230 preferably includes a fastener such as a nut, for example, a wing nut, (not shown) for screwing onto the adjustment mechanism 230 to secure the adjustment arms 220. The container preferably abuts the guideposts 205 and 210 in areas opposite the adjustment mechanism 230, or alternatively the container sets between the guideposts 205 and 210 and the adjustment mechanism 230.

The adjustable guidepost system 200 is preferably utilized to allow adjustment of one or both of the guideposts 205 and 210. To operate the adjustable guidepost system 200, an operator preferably loosens the wing nut from the adjustment mechanism 230, thereby allowing the first and second adjustment arms 220 and 225, respectfully, to be moved. After moving one or both of the adjustment arms to accommodate the container, the operator then preferably tightens the nut on the adjustment mechanism 230, thereby preventing the adjustment arms from being moved.

After being presented with the disclosure herein, those skilled in the relevant art will realize that the adjustable guidepost system 200 may be implemented in a variety of forms. For example, in at least one embodiment of the invention, the base 105 includes at least one guidepost, that is non-adjustable. As the at least one guidepost is fixed, it preferably does not rest on an adjustment arm. Thus, in such an embodiment, a sole adjustment arm preferably exists with an adjustable guidepost.

Figure 3:
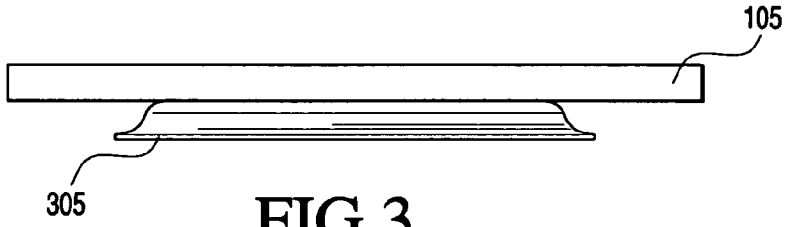
FIG. 3 depicts an undersurface of the base of the apparatus including a leg according to at least one embodiment of the present invention.

Alternatively, instead of having guideposts, a single column is present on the base 105. In such an embodiment, the single column preferably includes at least one hollow end and has a diameter or perimeter that is at least as large as the diameter or perimeter of the bottom of the container such that the container rests inside the column, thereby securely supporting the container. The column may include friction material to prevent the container from rotating during opening/closing operations. It should be noted that in at least one embodiment, the base 105 preferably includes at least one leg or suction cup 305 residing underneath to prevent slippage of the base 105, as illustrated in FIG. 3.

Referring again to FIG. 1, the balancer 110 preferably serves as a stabilizing means and is preferably coupled to the base 105 via a fastener, for example, a bolt. The balancer 110 preferably holds the rotational drive means 120. It should be noted that in at least one embodiment, the balancer 110 and the base 105 are preferably molded to form a unitary piece.

Figure 5:
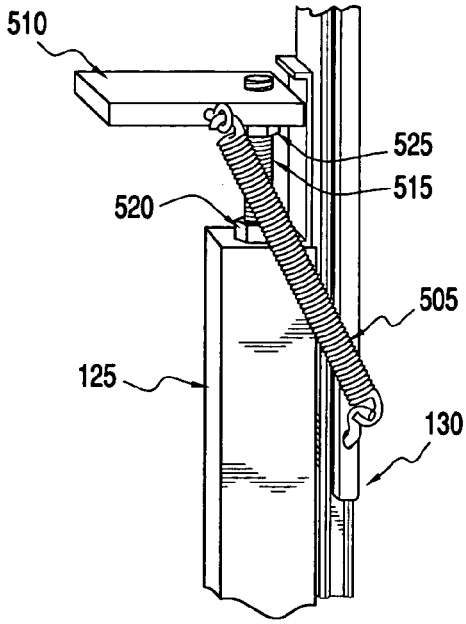
FIG. 5 illustrates the rear of the post of the apparatus according to at least one embodiment of the present invention.
Figure 6:
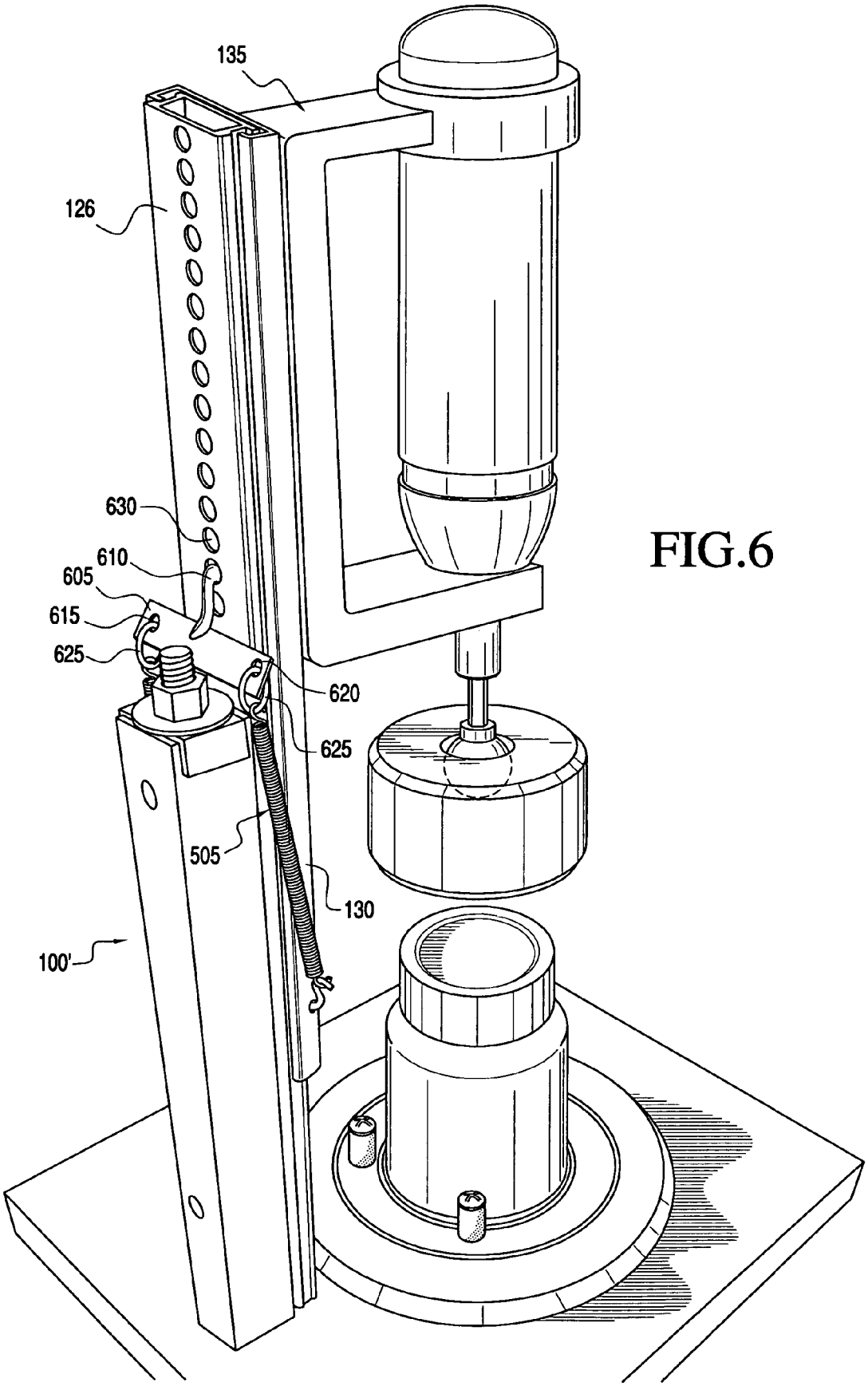
FIG. 6 illustrates an alternative embodiment of the invention in which a tension adjuster lever is used and a unitary bracket is present.

The balancer 110 preferably includes a post 125 having a slide support 126 such as the rail configuration illustrated in, for example, FIGS. 1, 5, and 6. Alternatively, the slide support 126 may be a separate piece that is coupled or attached to the post 125. The balancer 110 further includes a slide 130, which is slidably coupled to the slide support 126, and together these pieces form a means for sliding.

The slide 130 preferably includes a means for holding the rotational drive means (or holding means) such as the illustrated first bracket 140 and second bracket 135 in FIG. 1. The slide 130 is preferably interconnected with the post 125 such that the slide 130 slides vertically from a first position on the post 125 to a second position on the post 125. In at least one embodiment, the slide 130 is a ball-bearing slide. The first bracket 140 and the second bracket 135 are preferably "L-shaped" in the vertical direction and are fixedly attached to the slide 130. The first bracket 140 preferably has an opening or hole and functions to allow the bit-end of the screwdriver 120 to rest (or nest) therein. The second bracket 135 preferably includes a retainer ring (or collar) 142 adapted to grasp the rotational drive means 120. The first and second bracket configuration allows both left and right-handed individuals to position the screwdriver 120 to best suit them. For example, an individual can rotate the tool while it is resting in the brackets 135, 140 to accommodate his or her handedness (that is, left-hand orientation or right-hand orientation). It should be noted that in at least one embodiment, there is a single bracket including a first portion (or arm) and a second portion (or arm) extending from a member, which also is an example of a holding means as illustrated, for example, in FIG. 6. In such a configuration, the first portion of the single bracket includes a retainer ring such as retainer ring 142, which is present in the second bracket 135. The second portion of the single bracket includes an opening such as the opening of the first bracket 140.

The rotational drive device 120 preferably attaches to a bit 122 coupled thereto (or means for providing a rotational movement of the lid) and together function to allow a lid to be removed or attached to a container, for example. Examples of a rotational drive device 120 include a powered screwdriver or drill or other devices capable of providing powered rotational forces that may be built as part of the slide. The rotational drive device 120, for example, is powered by electricity or battery power.

Figure 4:
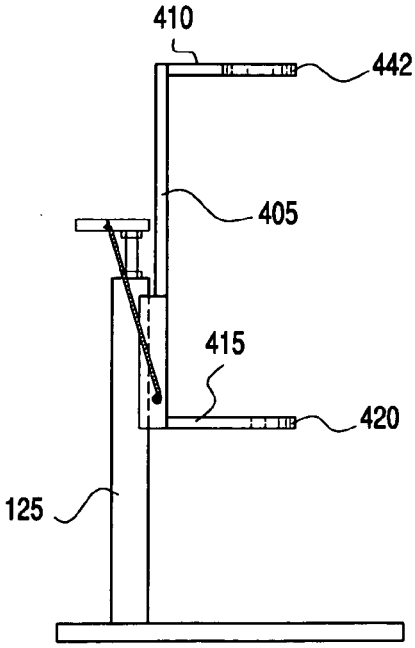
FIG. 4 depicts an alternative embodiment of the apparatus having a sole bracket according to at least one embodiment of the present invention.

FIG. 4 illustrates an exemplary embodiment where the slide 130 integrally formed with a single bracket 405. The bracket 405 is interconnected with the post 125 such that the bracket 405 vertically slides along the post 125 similar to the way the slide 130 operates as described above. The bracket 405 includes a first mount 410 and a second mount 415 wherein the first mount 410 includes a retainer ring 442, and the second mount 415 includes an opening (or hole) 420 for allowing the bit-end of the rotational drive means 120 to rest therein.

Referring now to FIG. 5, an "up-close" rear view of the apparatus 100 is shown. In particular, the rear of the post 125 is shown. In addition to the post 125 and the slide 130, FIG. 5 illustrates a tension means for resisting movement of the sliding means relative to the post (or means for providing adjustable tension) that includes a tension spring 505, a tension lever 510, a fastener (or bolt) 515, a fastener nut 520, and a tension lever nut 525. The tension lever 510, the fastener 515, and the tension lever nut 525 together form a tension mechanism. It should be noted that the apparatus 100 preferably includes two tension springs. One of the two tension springs is not shown in FIG. 5. Both the fastener nut 520 and the tension lever nut 525 are preferably screwed onto the fastener 515. The fastener 515 functions to attach the base 105 to the post 125. For example, in at least one embodiment, the fastener is a bolt having a length equal to or approximately equal to the post 125 and extends through the post 125 lengthwise, thereby attaching the base 105 to the post 125. The fastener nut 520 functions to secure the fastener 515, thereby securing the base 105 to the post 125. The tension lever 510 is preferably screwed atop the tension lever nut 525. The tension lever nut 525 functions to secure the tension lever 510 to the fastener 515. As illustrated in FIG. 5, one end of the tension spring 505 is preferably coupled to the tension lever 510, and the other end of the tension spring 505 is coupled to the slide 130, as illustrated in FIGS. 1 and 5. After being provided with the disclosure herein, it will become apparent to one of ordinary skill in the art that a variety of methods may be utilized for coupling the tension spring 505 to the slide 130 and the tension lever 510.

In an alternative embodiment where the base is welded or molded to the post, the fastener 515 and fasteners nut 520 are preferably not present. In such a configuration, a fastener such as a bolt or screw, for example, is placed atop the post. A tension lever and a tension lever nut are preferably included on the bolt. At least one tension spring can be coupled to the tension lever similar to the configuration described in FIG. 5.

To operate the apparatus 100, an operator preferably grasps the attached rotational drive means 120 and pulls downward. As the operator pulls the rotational drive means 120 in a downward motion, the tension spring 505 engages to balance or counter the weight of the operator's hand and the weight of the rotational drive means 120. Such balancing continues as the operator utilizes the bit 122 coupled to the rotational drive means 120 to attach or remove a lid from a container, for example. After utilizing the bit 122 of the rotational drive means 120 to attach or remove the lid from the container, as the operator ceases pulling the rotational drive means 120 downward, the tension spring 505 slowly disengages. In at least one embodiment of the invention, the tension spring 505 disengages as quickly or slowly as the operator releases the downward pressure applied. In other words, if the operator quickly releases the rotational drive means 120, the tension spring 105 quickly disengages, thereby allowing the slide 130 and the rotational drive means 120 to which the slide is coupled to return to its initial position. As previously noted, the apparatus performs the repetitive and cumulative motions, for example, removing and attaching the lid to the container, thereby minimizing or eliminating an individual's exposure to the associated health risks referenced above.

It should be noted that the number of tension springs may vary according to embodiments of the present invention. For example, a tension spring 505 is preferably located on each side of the tension lever 510. Spring tension is preferably decreased by screwing the tension lever nut 525 on the fastener 515 such that the distance between the fastener nut 520 and the tension lever nut 525 is decreased. Similarly, spring tension is preferably increased by screwing the tension lever nut 525 on the fastener 515 such that the distance between the fastener nut 520 and the tension lever nut 525 is increased.

Referring now to FIG. 6, a rear perspective view of the apparatus 100' is shown that illustrates another example of a tension means. In the embodiment shown in FIG. 6, however, the tension lever 510 and the tension lever nut 525 are not present. Rather, as illustrated in FIG. 6, a tension adjuster bar 605 is present. In the illustrated embodiment, the tension adjuster bar (or adjuster) 605 includes a lever 610 and a crossbar with two holes or openings 615 and 620. The lever 610 rests (or hooks or engages) in at least one hole or opening 630 of the slide support 126, which has a plurality of holes 630 along a surface opposite the slide 130. The adjuster 605 and holes 630 are another example of a tension mechanism. In at least one embodiment, each hole or opening 615 and 620 attaches to a ring 625. Alternatively, the rings 625 may be omitted (not shown).

One end of the tension spring 505 is preferably coupled to the ring 625, and the other end of the tension spring 505 is coupled to a hook on the slide 130 as illustrated in FIG. 6. It should be noted, however, that in the embodiment in which the ring 625 is not present, one end of the tension spring 505 is connected directly to the opening (or hole) 615, and the other end of the tension spring 505 is coupled to the slide 130.

An operator of the apparatus 100' adjusts tension of the spring 505 by pulling the tension adjuster bar 605 upward or downward such that the lever 610 rests in at least one opening 630 of the slide support 126, which as illustrated has a plurality of holes spaced along its length to allow the user to set the desire tension of the springs 505. For example, to increase tension of the spring 505, an operator of the apparatus 100' pulls the tension adjuster bar 605 away from the slide support 126 and then in an upward and opposite direction from the base 105 such that the lever 610 of the tension adjuster bar 605 fits into the desired opening or hole 630 of the slide support 126. To decrease tension of the tension spring 505, an operator of the apparatus 100' pulls the tension adjuster bar 605 away from the slide support 126 and allows the spring to release its tension as the operator places the extrusion 610 of the tension adjuster bar 605 into one of the openings or holes 630 below the opening or hole 630 from which the extrusion 610 was removed.

Figure 7:
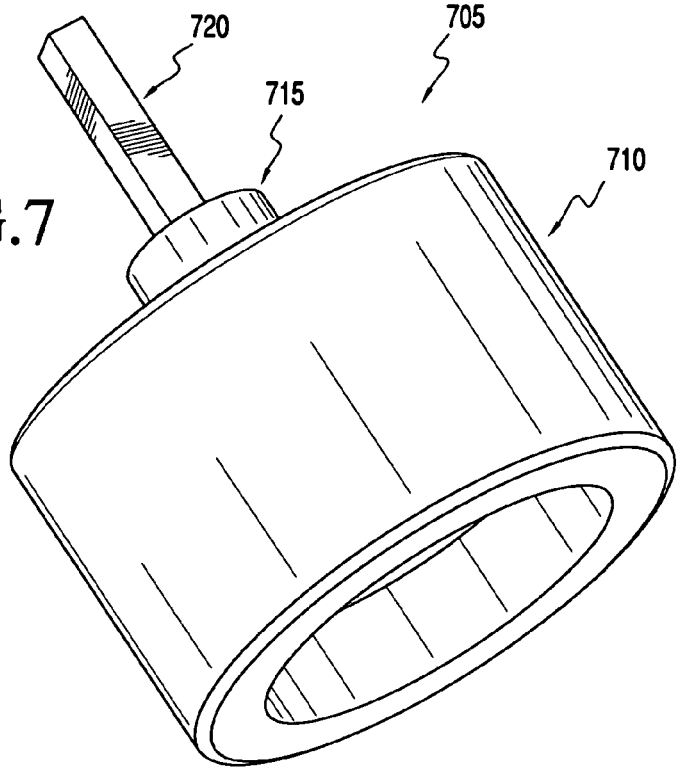
FIG. 7 depicts a bit capable of being utilized according to at least one embodiment of the present invention.

FIG. 7 illustrates an exemplary bit 705, which can be used for bit 122 shown in, for example, FIG. 1, for insertion into the rotational drive means 120. The bit 705 preferably includes a hub 710, an intermediary 715, and an adapter 720. In at least one embodiment, the intermediary 715 is manufactured of aluminum and allows the adapter 720 to be press fitted therein. It should be noted that the intermediary 715 should be of a sufficient thickness to accommodate the torque produced (for example, 0.500 inches thick).

The adapter 720 fits into the rotational drive means 120, thereby securing the bit 705 to the rotational drive means 120 and as such preferably about 0.25 inches in diameter or a other sizes as known to those of ordinary skill in the art. For example, in at least one embodiment, one end of the adapter 720 is machine-pressed into the intermediary 715, and the other end of the adapter 720 is inserted into the rotational drive means 120. Alternatively, the adapter 720 is detachable from the intermediary 715, as would be known to one of ordinary skill in the art after being presented with the disclosure herein.

Figure 8:
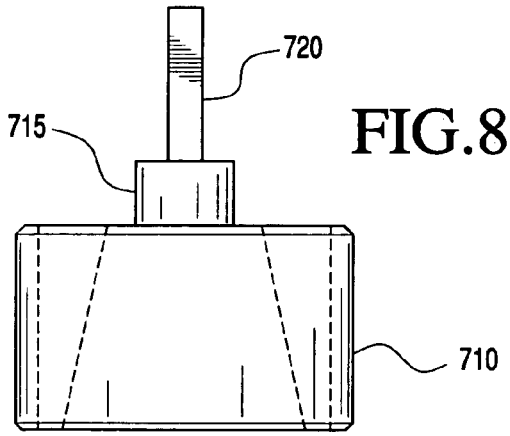
FIG. 8 illustrates a side view of the bit depicted in FIG. 7.

The intermediary 715 preferably couples the hub 710 to the adapter 720. As illustrated in FIG. 6 the intermediary 715 may couple with the hub 710 through a ball and socket configuration, and this configuration is useful if the lid of the container is not horizontal relative to the bit. FIG. 8 illustrates the intermediary 175 being joined to the hub 710.

The hub 710 preferably fits snugly over a lid of a container, for example, thereby allowing the lid to be removed from the container upon operation of the apparatus 100. The hub 710 preferably is lined with a hard rubber lining or similar material for gripping container lids. Another material found to work well for this purpose is the hook portion of Velcro arranged in small strips along the inner surface of the hub 710. The hub 710 preferably includes an inner surface that is tapered to allow for a variety of sized containers to fit within the hub as illustrated, for example, in FIGS. 8 and 9.

Figure 10A:
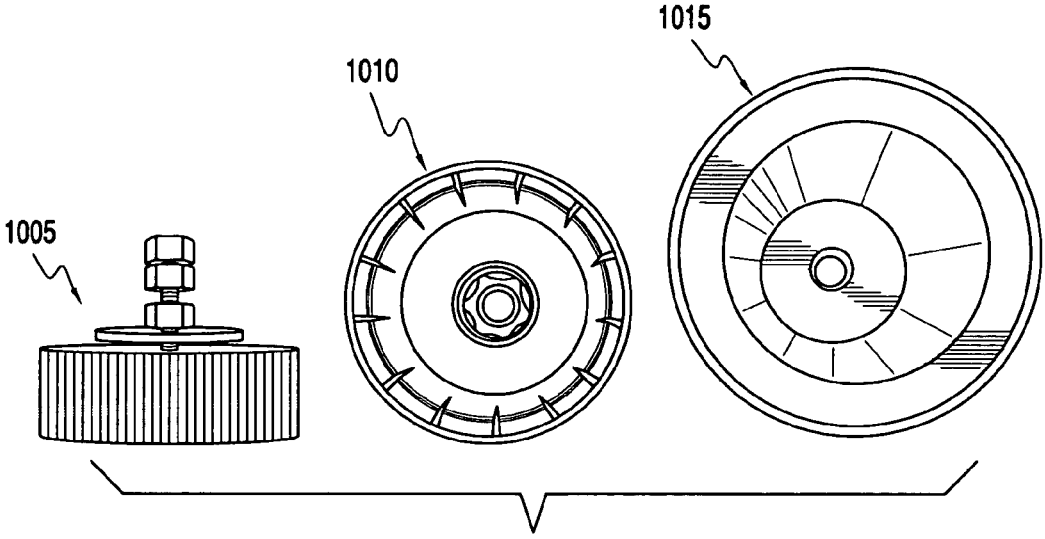
FIGS. 10A and 10B illustrate bits having a variety of sizes according to the present invention.
Figure 10B:
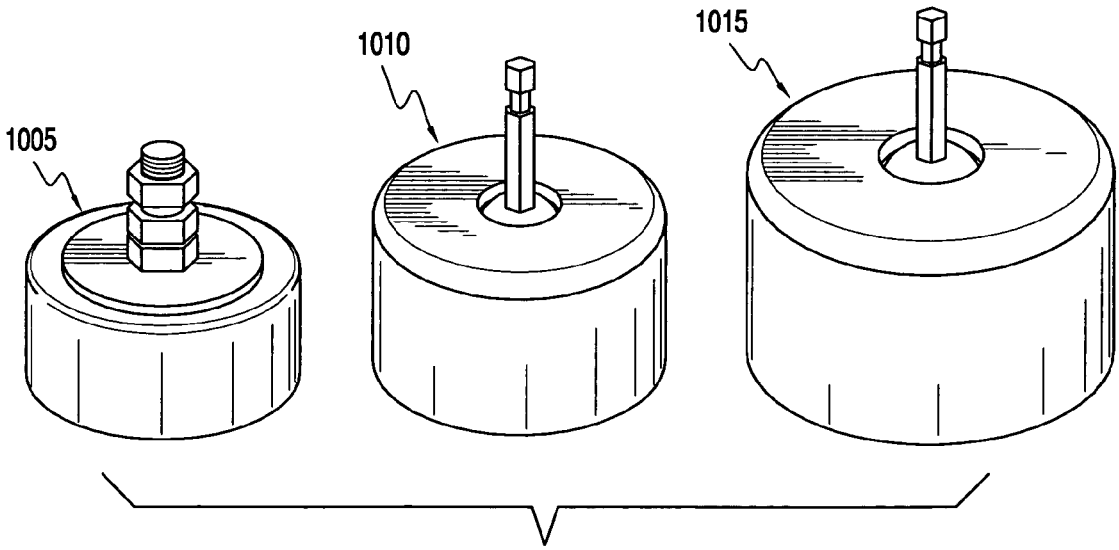

In at least one embodiment, the hub 710 can have a variety of sizes and dimensions as illustrated, for example, in FIGS. 10A and 10B. Some exemplary dimensions for the bit include the following: the hub 710 having a height of approximately 1.625 inches, the intermediary 715 having a height of approximately 0.500 inches, the adapter 720 having a height of approximately 1.188 inches and a diameter of approximately 0.250 inches. The length of the adapter 720 may vary according to the exact implementation of the invention.

Figure 9:
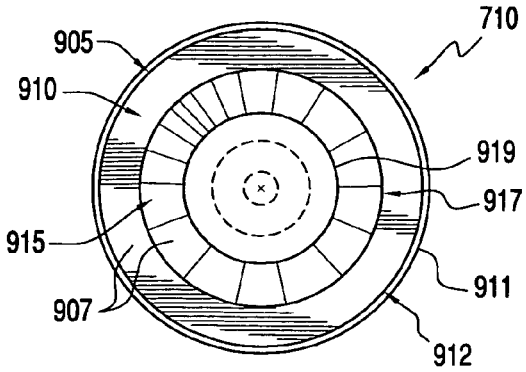
FIG. 9 illustrates a bottom view of the bit depicted in FIG. 7.

FIG. 9 illustrates a bottom view of the hub 710 of the bit 705 shown in, for example, FIG. 7. The hub 710 preferably includes an outer surface 905 and an inner surface 907. The outer surface 905 is preferably manufactured of aluminum or any other type of viable material. The inner surface 907 preferably includes an outer section 910 adjacent to the outer surface 905, and an inner section 915 adjacent to the outer section 910. The sections are preferably tapered and manufactured of rubber, nylon, or any other viable material that is capable of engaging and turning container lids. It should also be noted that the sections included in the inner surface 907 are preferably beveled to allow accommodation for a variety of sizes of lids.

After being provided with the disclosure herein, one skilled in the relevant art will realize that a variety of dimensions may be utilized without departing from the scope and spirit of the present invention. Exemplary dimensions for the hub include the following: the outer surface 905 having a thickness of approximately 0.125 inches with an outer diameter 911 of 2.50 inches, the outer section 910 lined with a approximately 0.250 inches thick layer with an outer diameter 912 of 2.25 inches, the inner section 915 includes a tapered layer approximately 0.5625 inches thick with an outer diameter 917 of 1.750 inches, and the inner section 915 having an inner diameter 919 of approximately 1.125 inches.

Referring to FIGS. 10A and 10B, three bits according to at least one embodiment of the present invention are shown. The bits depict a variety of exemplary sizes. The inside of each bit preferably varies according to the particular embodiment of the invention, i.e., the diameter and size of the lid and the container. FIG. 10A illustrates a bit 1010 that includes a plurality of ribs (or slates) for the gripping surface. FIG. 10A illustrates a bit 1015 that includes a conical configuration for the gripping surface. FIG. 10A also illustrates another exemplary bit 1005.

The exemplary and alternative embodiments described above may be combined in a variety of ways with each other.

The present invention as described more fully above with reference to the accompanying drawings, in which preferred and exemplary embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. The accompanying drawings show exemplary embodiments of the invention.

Those skilled in the art will appreciate that various adaptations and modifications of the exemplary and alternative embodiments described above can be configured without departing from the scope and spirit of the invention. Therefore, it is to be understood that, within the scope of the appended claims, the invention may be practiced other than as specifically described herein.

The invention claimed is:

1. An apparatus for fastening and unfastening a lid to a container with a rotational drive device, said apparatus comprising:

a platform, a post connected to said platform, a holding means for holding the rotational drive device, a sliding means for sliding said holding means relative to said post, and a tension means for providing adjustable tension between said sliding means and said post.

2. The apparatus of claim 1, wherein said platform includes a restraining means for restraining the container.

3. The apparatus of claim 2, wherein said restraining means includes an adjustment mechanism connected to the top surface of said platform, a first adjustment arm pivotally connected at one end to said adjustment mechanism, said first adjustment am having a guidepost at the other end, and a second adjustment arm pivotally connected at one end to said adjustment mechanism, said second adjustment arm having a guidepost at the other end.

4. The apparatus of claim 1, wherein said tension means includes a fastener connected to said post, a tension lever engaging said fastener, a tension nut engaging said fastener, and at least one spring connecting said post to said sliding means.

5. The apparatus of claim 1, wherein said tension means includes a plurality of openings spaced along at least a portion of the surface of said post opposite said sliding means;

an adjuster having a crossbar with an opening passing through each end, and a lever spaced from the openings and connected to said crossbar, said lever capable of engaging one of the plurality of openings of said post; and at least two springs, each spring connected to said sliding means and a respective end of said crossbar.

6. The apparatus of claim 5, wherein said tension means further includes at least two rings, each ring connecting one spring to the respective opening in said crossbar.

7. The apparatus of claim 1, wherein said sliding means and said holding means together form a bracket, said bracket is in sliding engagement with said post.

8. The apparatus of claim 1, further comprising a suction cup attached to the bottom of said platform.

9. A system for fastening and unfastening a lid to a container, said system comprising:

a battery powered screwdriver, a bit configured to fit around the lid of at least one container, a platform, a post connected to said platform, a holding means for holding said screwdriver, a sliding means for sliding said holding means relative to said post, and a tension means for resisting movement of said sliding means relative to said post;

said holding means is capable of holding said screwdriver in an orientation substantially perpendicular to said platform such that said bit is orientated to engage the container placed on said platform.

10. An apparatus for fastening and unfastening a lid to a container, said apparatus comprising:

a platform, a post connected to said platform, a slider in communication with said post, a tension means for resisting movement of said slider relative to said post, at least one bracket attached to said slider, a rotational drive device in communication with said at least one bracket, said rotational drive device is rotatable relative to said at least one bracket, and at least one bit capable of being attached to said rotational drive device.

11. The apparatus of claim 10, wherein said at least one bracket includes a first bracket attached to said slider and having an opening passing therethrough, the opening capable of nesting said rotational drive device such that said first bracket supports said rotational drive device; and a second bracket attached to said slider and having an opening passing therethrough, the opening capable of nesting said rotational drive device.

12. The apparatus of claim 10, wherein said at least one bracket includes a first bracket attached to said slider and having an opening passing therethrough, the opening capable of nesting said rotational drive means such that said first bracket supports said rotational drive device; and a second bracket attached to said slider with an arm extending sway from said slider, said arm having a collar capable of nesting said rotational drive device.

13. The apparatus of claim 10, wherein said at least one bracket includes a bracket having a member attached to said slider and an arm extending from either end of said member, each arm having an opening passing therethrough capable of nesting said rotational drive device.

14. The apparatus of claim 10, wherein said tension means includes a fastener connected to said post, a tension lever engaging said fastener, a tension nut engaging said fastener, and at least one spring connecting said post to said slider.

15. The apparatus of claim 10, wherein said tension means includes a plurality of openings spaced along at least a portion of the surface of said post opposite said slider;

an adjuster having a crossbar with an opening passing through each end, and a lever spaced from the openings and connected to said crossbar, said lever capable of engaging one of the plurality of openings of said post; and at least two springs, each spring connected to said slider and a respective end of said crossbar.

16. A device for fastening and unfastening a lid to a container, said device comprising:

a platform, a post connected to said platform, a slider engaging said post, a tension mechanism in communication with said post, at least one spring connecting said tension mechanism to said slider, a rotational driver device connected to said slider, and a bit attached to said rotational driver device configured to fit around the lid of at least one container.

17. The device of claim 16, further comprising:

a first bracket member attached to said slider, said first bracket member including an opening passing therethrough through which said rotational driver device passes through, and a second bracket member attached to said slider, said second bracket member including a retainer ring that nests around said rotational driver device.

* * * * *